US006004089A

United States Patent [19]

Legresy et al.

[11] Patent Number: 6,004,089

[45] Date of Patent: Dec. 21, 1999

[54] METHOD FOR MAKING EASY-OPEN LIDS WITH IMPROVED SCORING

[75] Inventors: Jean-Marc Legresy, St. Egreve; Jean-Pierre Richard, Le Mans; Marc Langouet, St. Leu la Foret, all of France

[73] Assignee: Impress Metal Packaging S.A., Clichy, France

[21] Appl. No.: 08/930,431

[22] PCT Filed: Apr. 15, 1996

[86] PCT No.: PCT/FR96/00571

§ 371 Date: Nov. 21, 1997

§ 102(e) Date: Nov. 21, 1997

[87] PCT Pub. No.: WO96/32334

PCT Pub. Date: Oct. 17, 1996

[30] Foreign Application Priority Data

Apr. 14, 1995 [EP] European Pat. Off. ..... 95420100

[51] Int. Cl.[6] ..... B65D 17/28; B21D 51/44

[52] U.S. Cl. ..... 413/17; 220/266; 413/67

[58] Field of Search ..... 413/17, 67; 220/266, 220/277, 276, 269; 72/348, 325

[56] References Cited

U.S. PATENT DOCUMENTS

| | | | |
|---|---|---|---|
| 3,338,199 | 8/1967 | Taylor | 413/17 X |
| 3,650,006 | 3/1972 | Kinkel | 413/17 X |
| 3,946,683 | 3/1976 | Jordan | 413/17 |
| 3,964,414 | 6/1976 | Gane | 413/17 |
| 3,977,341 | 8/1976 | Jordan et al. | 413/17 |
| 5,252,019 | 10/1993 | Saunders et al. | 413/67 |

FOREIGN PATENT DOCUMENTS

| | | |
|---|---|---|
| 2079293 | 11/1971 | France . |
| 2051697 | 5/1971 | Germany . |

*Primary Examiner*—James F. Coan
*Attorney, Agent, or Firm*—Dennison, Meserole, Scheiner & Schultz

[57] ABSTRACT

A process for forming an easy open lid comprising a central panel having a score strip with a score thereon, a crimping edge and a ring enabling the lid to be opened by perforation of the score. The score on the lid is formed from a metal lid outline supported by an anvil by displacing a punch of angle alpha thereover and causing an asymmetrical flow of metal between the punch and the anvil during the displacing. This reduces the risk of crack formation in the metal at the bottom portion of the score or beneath the score.

19 Claims, 7 Drawing Sheets

FIG. 4A
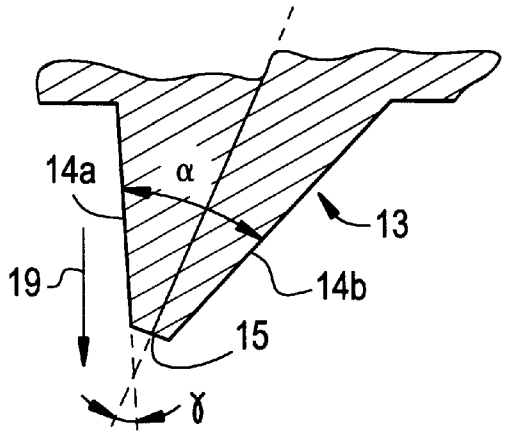
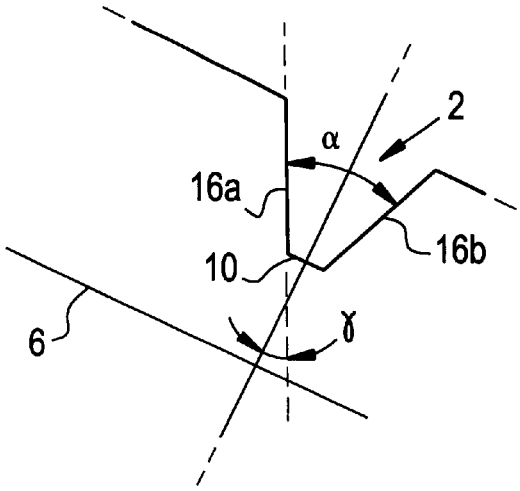
FIG. 4B
FIG. 5A
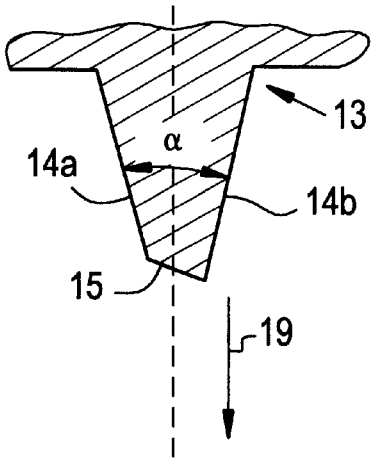
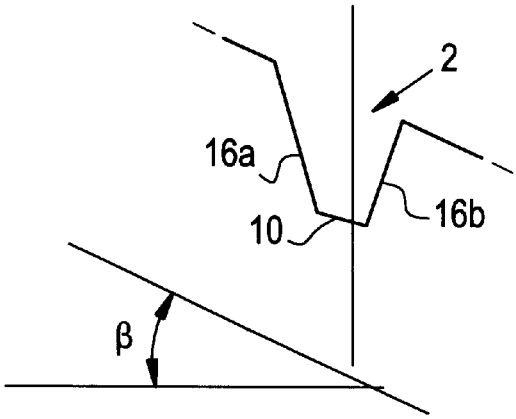
FIG. 5B

METHOD FOR MAKING EASY-OPEN LIDS WITH IMPROVED SCORING

BACKGROUND OF THE INVENTION

1. Field of the Invention

The present invention relates to the field of easy-to-open containers and receptacles, and more specifically to easy-to-open metal lids.

2. Description of Related Art

Easy-to-open lids have a generally peripheral score, as in the case of containers for food products—illustrated in FIGS. 1*a* to 1*c*. FIGS.1*a* and 1*b* correspond to easy-to-open lids with a counter-dish. Alternatively, easy-to-open lids have a score defining a weak portion of the panel of the lid, as in the case of a drinks can lid.

The scores are defined by their profile and the thickness of residual metal under the score, which is also called the "residual".

A profile is defined by the angle alpha of the score and by the calculated width P at the bottom of the score. A typical score is shown diagrammatically in FIG. 2 together with its angle alpha and the width P, a score in which the angle alpha is equal to 60° and the width P is 40 $\mu$m being denoted symbolically by "60P40 ".

There is an ever-increasing demand for easy-to-open lids having simultaneously a greater ease of opening and a greater degree of security in production and use. However, these demands are at the present time to a large degree contradictory insofar as a greater ease of opening is generally obtained by reducing the residual. This reduction is however accompanied by much less production security (accuracy of larger tools, smaller safety margin), and above all by the very serious risk of cracks developing at the bottom of or underneath the score, resulting in leakages either directly, or by the action of pressure during packaging, typically involving sterilisation, or after packaging, due to the corrosive action of the packaged product.

Furthermore, the presence of weak residuals and/or cracks makes the lids more susceptible to perforations caused by shock during handling of the packaged products, in particular from the packaging of the product up to its final use by the consumer.

FIG. 7 illustrates a cross-section of a score after crimping and sterilisation, showing at the bottom of the score typical cracks that the present invention aims to suppress if not entirely, then at least to a very great extent. FIG. 7 also shows starting points or foci of cracks underneath the score.

The problem is to find a way of reliably and economically manufacturing easy-to-open lids having a weak residual in which the bottom of the scores does not exhibit cracks at the end of the production stage nor after packaging of the product being packed, so as to present, despite a weak residual, a satisfactory behaviour to mechanical stresses and corrosion.

SUMMARY

According to the invention there is provided, a method for making an easy-to-open metal lid (1) with a central panel (3) and crimping edge (4), comprising a score (2) on a score strip (6), part of the panel on which the score is formed, and a ring (8) enabling the lid to be opened by perforating the score, wherein the score (2) is formed by displacement of a punch (13) of angle alpha over the score strip (6) of a lid outline, supported by an anvil (21), characterised in that in order to reduce the risk of formation of cracks at the bottom of or underneath the score, the score (2) is formed using any means leading to an asymmetrical flow of the metal between the punch (13) and the anvil (21) during the displacement.

A first means leading to an asymmetrical flow of the metal consists in using a punch (130) asymmetrical as regards its geometrical configuration. As shown in FIG. 8, the line bisecting the angle alpha making a non-zero angle gamma with the direction of the displacement.

A second means, as shown in FIGS. 4*a* and 4*b*, 5*a* and 5*b*, 6*a* and 6*b*, consists in using a lid outline with a score strip (6) making an angle beta different from 0 with respect to the horizontal plane or different from 90° with respect to the direction of the displacement. The anvil (21), not shown in FIGS. 4*a* to 6*b*, has an inclination phi, as shown in FIG. 10, which may be different from the angle beta.

A third means consists in using a punch asymmetrical as regards its roughness, one side of the angle alpha of the punch being rougher than the other side, the punch moreover being symmetrical or otherwise as regards its geometrical profile.

A fourth possible means according to the invention consists in using an anvil (21) itself having a lower contour (210) that may be eccentric by at most 500 $\mu$m with respect to the punch (13,130), or asymmetrical (211) as shown in FIGS. 10 and 11.

These various means may be used individually or in combination.

These means illustrate in a specific but non-limiting manner the concept of asymmetrical flow according to the invention, which enables the aforementioned problem to be solved.

Figure 1A:
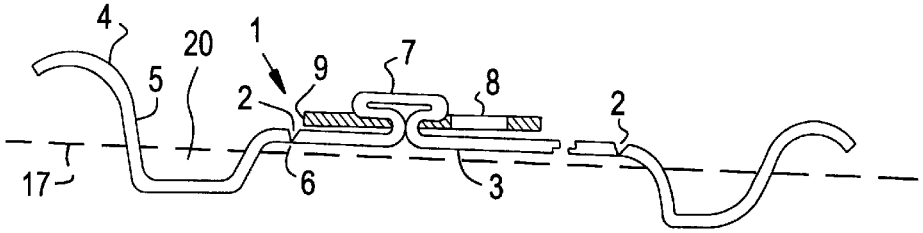
FIG. 1A PRIOR ART
FIGS. 1*a* to 1*c* are axial cross-sections of various forms of easy-to-open lids (1) of the prior art.

These lids comprise a central panel (3) on which is provided a score (2) on a score strip (6) in a horizontal plane parallel to the mid plane (17) of the panel (3), and a crimping edge (4).

The central panel is provided with a rivet (7) that secures in place a ring (8) whose tip (9) lies above the score (2) so as to effect opening of the lid on pivoting of the ring. The crimping edge (4) comprises a markedly inclined skirt portion (5) connected to the central panel, possibly by a counter-dish (20).

Figure 1B:
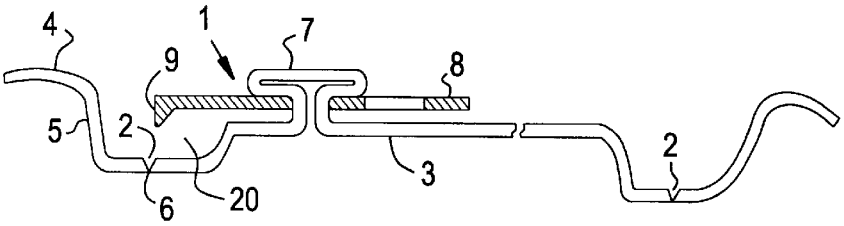
FIG. 1B PRIOR ART
Figure 1C:
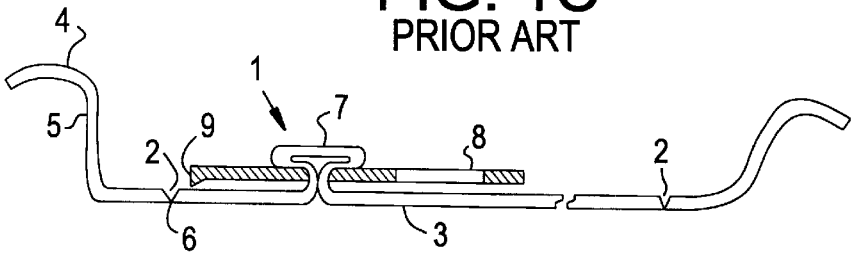
FIG. 1C PRIOR ART

FIGS. 1*a* to 1*c* are characterised by the presence of a counter-dish (20) in the case of FIGS. 1*a* and 1*b*, and by the position of the score (2), situated in the plane of the central panel in the case of FIGS. 1*a* and 1*c*, and at the bottom of the dish (20) in the case of FIG. 1*b*.

Figure 2:
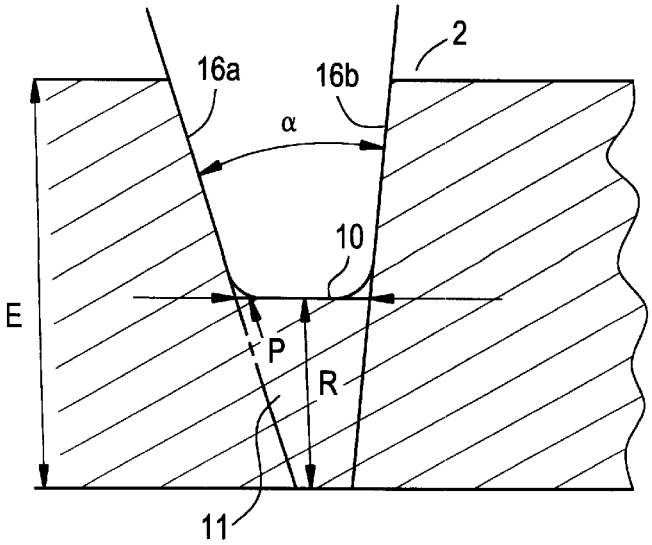

FIG. 2 is an axial cross-section of a score (2). A score (2) is defined, for a thickness E of the metal strip, by an angle alpha, by a calculated width P of the bottom (10) of the score, and by a value R of the residual thickness (11) (also called "residual"). The sides of the score are identified by the reference numerals 16*a* and 16*b*.

Figure 3A:
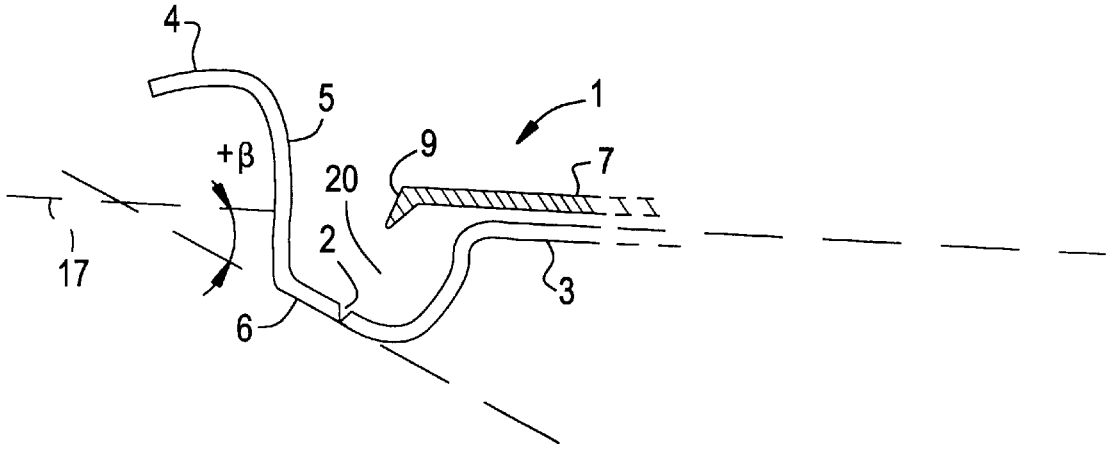
Figure 3B:
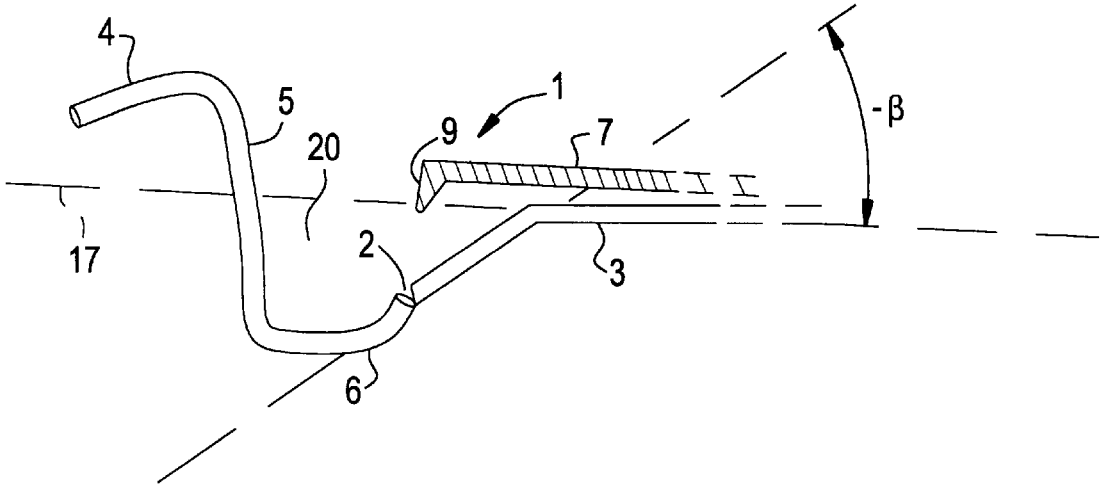
Figure 3C:
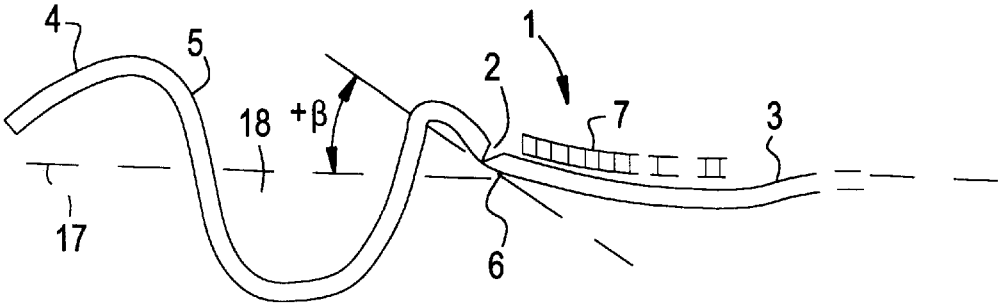

FIGS. 3*a*, 3*b* and 3*c* are axial cross-sections similar to that of FIGS.1*a* to 1*c*, of portions of easy-to-open lid (1) according to the invention, having an inclined score strip (6).

FIGS. 3*a* and 3*b* show the position of the score (2) on the score strip (3) forming the bottom of the dish (20). This strip (6) has an angle of inclination beta with respect to the plane (17), corresponding to the horizontal mid-plane of the central panel (3).

In FIG. 3*a* the strip (6) has an inclination of angle +beta, whereas in FIG. 3*b* the angle is −beta.

FIG. 3*c* shows the position of the score (2) on the score strip (6) forming the periphery of the central panel (3), bounded on the outside by the counter-dish (18). This strip (6) has an inclination of angle +beta with respect to the plane (17).

Figure 3D:
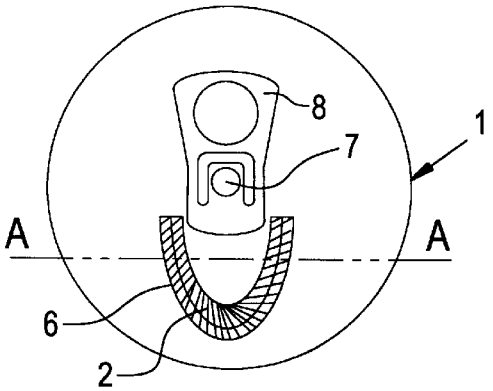
Figure 3E:
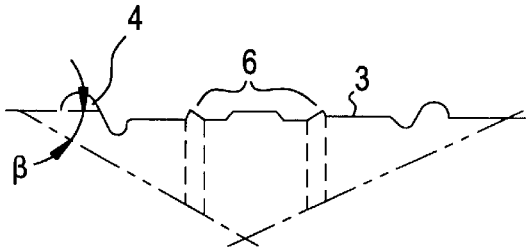

FIGS. 3*d* and 3*e* refer to a partially open lid of a drinks can. FIG. 3*d* is a view from above and FIG. 3*e* is a section along the line A—A of FIG. 3*d*. With this type of lid the score strip (6) does not form a strip closed on itself, but instead has a horseshoe shape, the open part of which remains attached to the central panel (3) of the lid. The ring (8) is positioned to the side of this open part, and when pivoted forwards punctures the score (2) and forces the tongue portion defined by the said score (2) into the interior of the can.

Figure 3F:
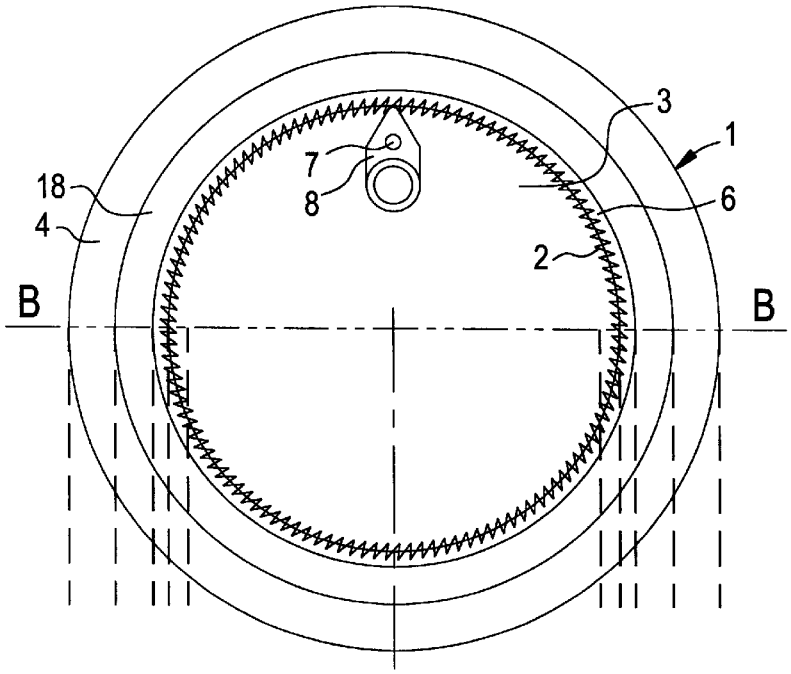
Figure 3G:
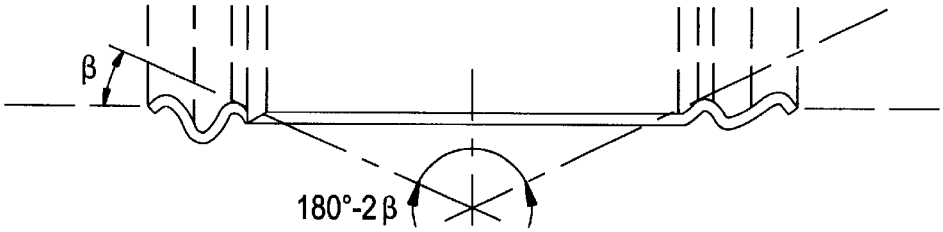

FIGS. 3*f* and 3*g* refer to the lid of FIG. 3*c*. FIG. 3*f* is a view from above showing the score strip (6) in the form of a hatched crown, the score (2) passing through the center of this strip.

FIG. 3*g* is an axial section along the line B—B of FIG. 3*f*, showing that the strip (6) has the shape of a conical portion whose vertex angle is equal to 180°−2×beta.

Figure 6A:
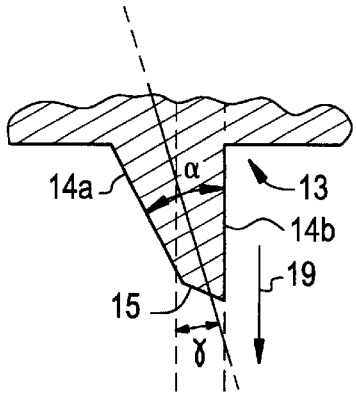
Figure 6B:
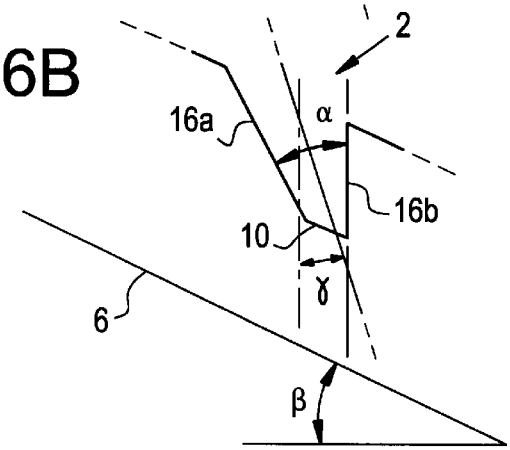

FIGS. 4*a*, 5*a* and 6*a* are partial axial sections of symmetrical punches (13) or asymmetrical punches (130) intended to form scores (2) according to the invention, the two sides (14*a*, 14*b*) of the punch forming an angle alpha and being connected at one end (15). The punches move along the vertical direction (19) so as to form the corresponding scores (2) shown in FIGS. 4*b*, 5*b* and 6*b*. These figures show the limits of the inclination of the punch of angle gamma with respect to the vertical:

- in FIG. 4*a*, one limit of the angle gamma is reached since the side 14*a* of the punch is vertical,
- in FIG. 6*a*, the other limit of the angle gamma is reached since the other side 14*b* of the punch is vertical,
- FIG. 5*a* shows an intermediate case in which the angle gamma is equal to zero.

Figure 7:
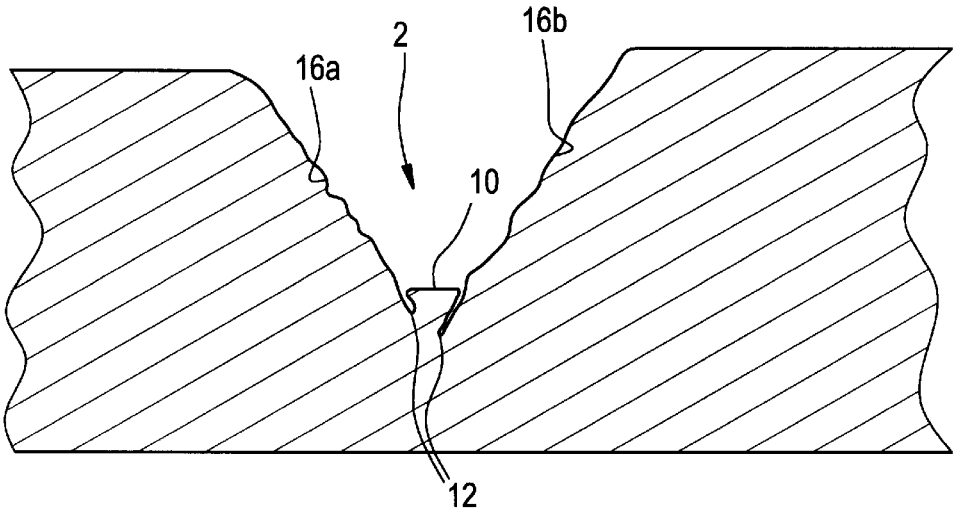
FIG. 7 PRIOR ART

FIG. 7, which is similar to FIG. 2, is a micrograph section showing the presence of cracks (12) at the bottom of the score (10), and starting points of cracks under the score, in the case of scores according to the prior art.

Figure 8:
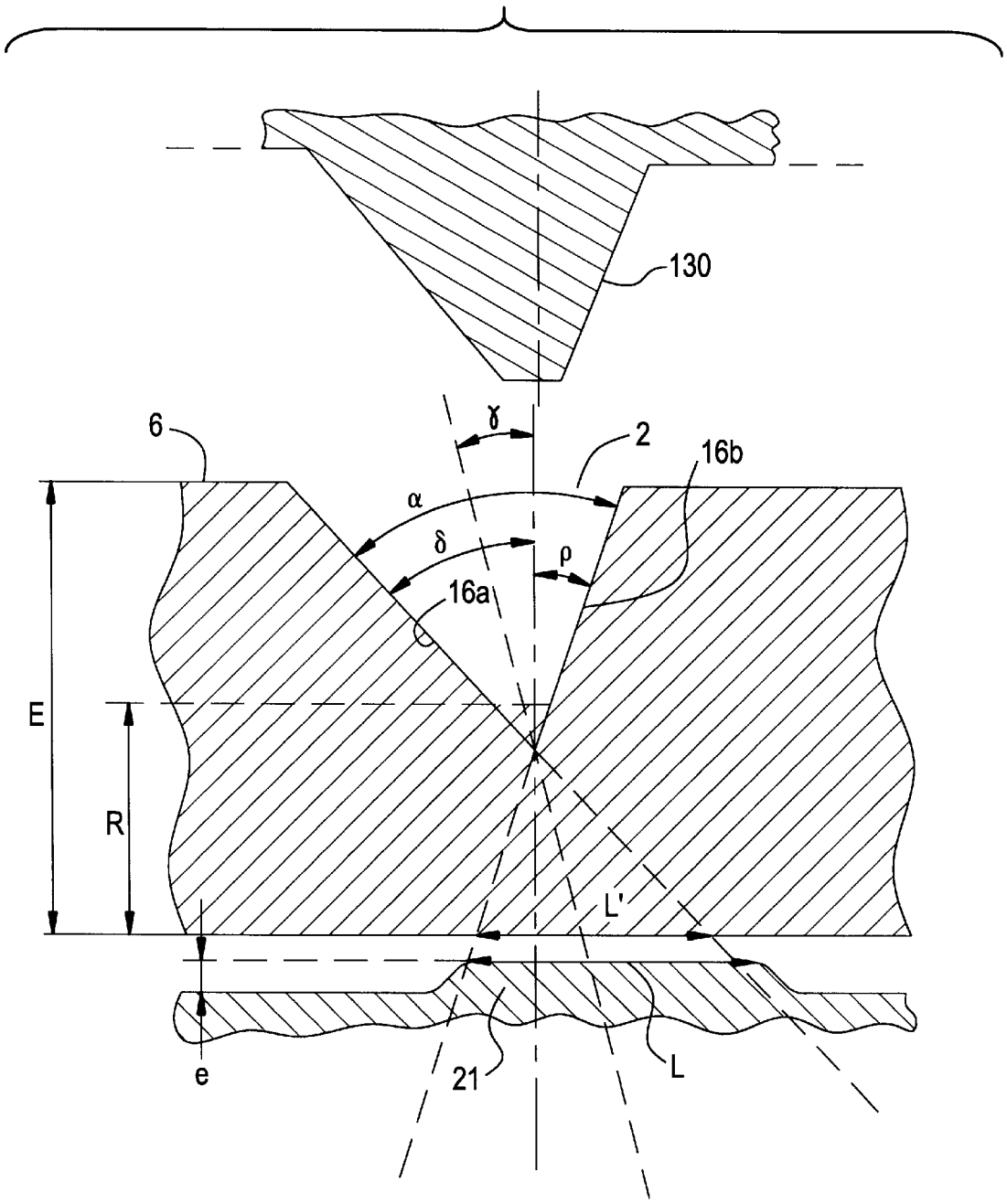

FIG. 8, which is similar to FIG. 2, shows a score obtained with an asymmetrical punch of angle alpha equal to 50°, and in which the bisecting line makes an angle gamma equal to 10° with the vertical.

The angle delta is equal to 35°, and the angle rho is equal to 15°.

This figure shows the intersection L' of the base of the score strip (6) with the extensions of the sides (16*a*, 16*b*) of the score (2) and, opposite thereto, the anvil of length L and thickness e.

Figure 9:
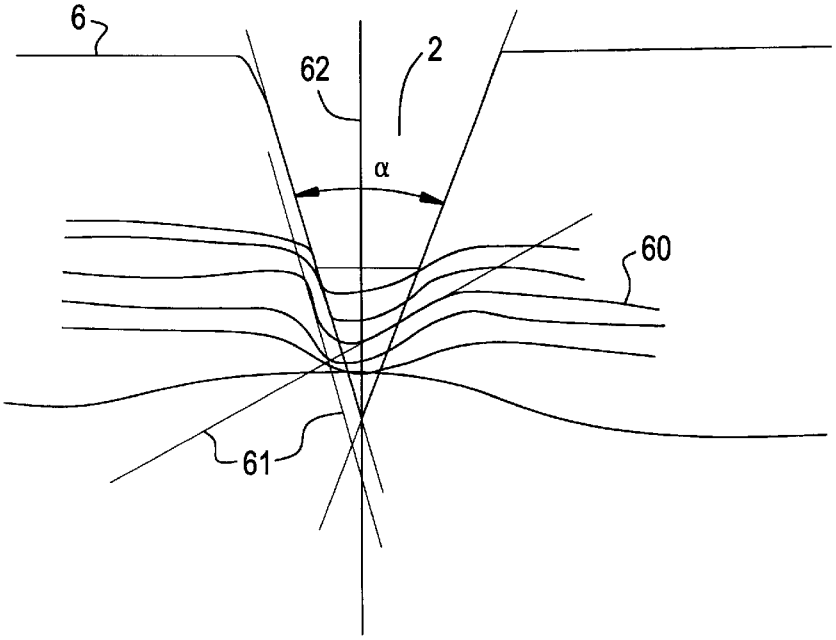

FIG. 9 shows a metallographic section of a score according to the invention after anodic oxidation, revealing the fibres of the metal, namely the extension of the aluminium grains represented by the lines (60). The intersection of the straight lines of inflection (61) relative to a same line (60) deviates from the line (62) bisecting the angle alpha, which is reflected in the asymmetrical flow according to the invention.

Figure 10:
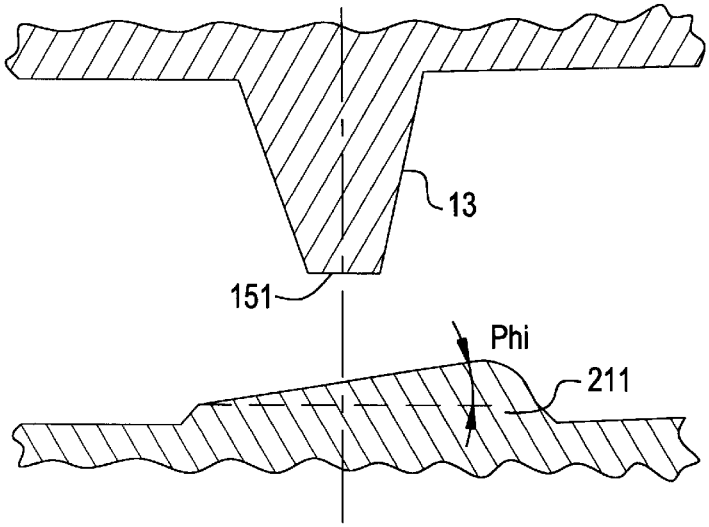

FIG. 10 is a cross-section of an inclined anvil (211) above which is arranged a symmetrical punch (13).

Figure 11:
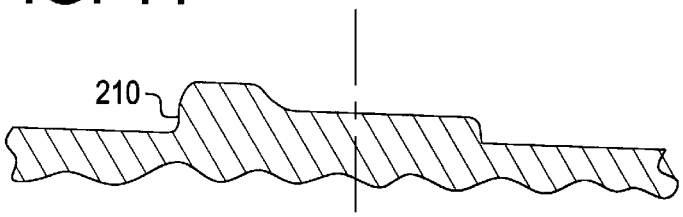

FIG. 11 is a cross-section of an anvil having a lower punch (210) eccentric with respect to the symmetrical punch (13).

DETAILED DESCRIPTION OF THE INVENTION

When an asymmetrical flow is produced by using a punch (130) that is asymmetrical as regards its geometrical configuration defined by the angle alpha of the punch and by the two angles delta and rho, resulting in the division of the angle alpha by the direction of the displacement of the punch (alpha=delta+rho), the geometrical characteristics of the asymmetrical punch (130) are defined by the combination of the following conditions:

- the angle alpha is between 30° and 70°, and preferably between 40° and 60°,
- the absolute value of the difference between the angles delta and rho is at least 3°.

Preferably, the absolute value of this difference is between 5° and 30°.

In the case of the second means for effecting asymmetrical flow involving a score strip (6) making an angle beta different from zero, the angle beta is generally between 5° and 45°, and preferably less than 30°.

The score strip (6) inclined at an angle beta is formed by stamping out the metal strip in a manner known per se during the formation of the lid outline and contour. Bearing in mind the high precision of the machine tools used to produce lids, it is sufficient for the strip to have a width of the order of 1 mm in order to be certain that the score (2) will always be accurately positioned on the strip (6) at an inclination of angle beta.

The punch (13) may furthermore be oriented at an angle gamma with respect to the perpendicular direction (19) contained between two extreme values such that one of the values corresponds to a punch having one of its faces vertical (16*a*), as shown in FIG. 4*a*, while the other value corresponds to a punch having the other of its faces (16*b*) vertical, as is shown in FIG. 6*a*.

The third way of achieving asymmetrical flow based on the use of a differential roughness of the punch is made possible by employing surface-treated scoring tools that are of sufficient hardness to preserve the differential roughness throughout the working life of the scoring tool.

The fourth way of achieving asymmetrical flow is based on the use of a special anvil (21) comprising:

- an asymmetrical lower relief (211) that is typically inclined and has an angle of inclination phi (see FIG. 10).
- a lower relief (210) slightly eccentric with respect to the upper punch (13) (see FIG. 11). This lower relief (210) could also be more accentuated and comprise a lower punch enabling a double score to be produced.

Regardless of the means adopted to achieve the asymmetrical flow, the punch (13) may be a radiused punch, the sides of the punch (14*a*, 14*b*) being connected to one another via the radii, or to a possible flat extremity (151) of the punch.

The punch (13) may have a flat extremity (151) of length generally between 0 and 25 μm, so as to produce a score of width P less than 40 μm, and preferably between 10 and 30 μm.

According to the invention the anvil (21) preferably has, and particularly when the anvil does not itself comprise a means for producing asymmetrical flow, a width L close to a theoretical width L' defined by the intersection of the base of the score strip with the extensions of the sides (16*a*, 16*b*) of the score (2), and has a thickness e of at least 10 μm and preferably less than the thickness E of the score strip (6)—see FIG. 8.

In the case where an asymmetrical punch is used, it is preferred that the anvil is positioned with respect to the intersection as illustrated in FIG. 8.

Another aspect of the invention is the lids obtained according to the process of the invention.

In easy-to-open metal lids (1) obtained according to the process of the invention, with a central panel (3) and crimping edge (4), comprising a score (2) on the score strip (6), part of the panel on which the score is formed and a ring (8) enabling the score to be perforated and the lid to be opened, the material comprising the lid is selected from steel and iron-based alloys, aluminium and aluminium alloys, the angle alpha of the score is between 30° and 70°, the thickness of the lid is between 0.12 and 0.30 mm (nominal thickness of the metal strip for the lid), and the residual thickness at the bottom of the score is greater than 40 μm.

For iron alloys, in particular white iron (tin-plated iron), TFS, and more generally iron alloys whose surfaces have been treated in ways known to the person skilled in the art so that they can be used as suitable material for manufacturing metal containers and receptacles, and particularly lids, the angle alpha is preferably between 40° and 60° and the calculated width P at the bottom of the score is between 10 and 40 μm.

If an asymmetrical flow scoring is carried out according to the invention, as illustrated in FIG. 9, it is easy to demonstrate that asymmetrical flow has occurred by considering the straight lines of inflection (61) for the same line of metal (60) under or in the vicinity of the score (2).

In the case of a symmetrical flow with a conventional score, the straight lines of inflection are substantially symmetrical with respect to the line (62) bisecting the angle alpha.

In the case where the asymmetrical flow is achieved by using a lid outline having a score strip making an angle beta different from 0 with respect to the horizontal plane, the final lid also has a score strip (6) making a non-zero angle beta with respect to the mid plane (17) of the central panel (3) regarded as the horizontal plane.

The score strip (6) may be located on the periphery of the central panel (3) and of the internal skirt portion (5) of the crimping edge (4), and may form an inclined plane between the central panel and the skirt portion, as shown in FIGS. 3*a* and 3*b*.

The lid may have a peripheral counter-dish (18) with an edge raised with respect to the central panel (3), the score strip (6), situated between the central panel and the counter-dish (18), forming an inclined plane as illustrated in FIGS. 3*c*, 3*f* and 3*g*.

The lid may be designed for partial opening, for example a lid for a drinks can, in which case the score strip (6) of the lid forms an inclined plane abutting the part of the panel intended to be opened, as illustrated in FIGS. 3*d* and 3*e*.

In all these lids, the angle beta is between 50° and 45°, and preferably between 10° and 30°.

EXAMPLES OF IMPLEMENTATION

All the easy-to-open lids produced from aluminium alloy strip 5052 (designation according to the Aluminum Association) have a nominal thickness of 230 μm, are surface coated on both sides, and have a metallurgical state H48 corresponding to a highly cold-hammered state, restored during the surface coating procedure.

Standard easy-to-open lids (1) were manufactured, having a diameter of 73 mm, with a peripheral score according to FIG. 3*a* and the score having a "60P40" type profile (angle alpha of 60° and a calculated flat value at the bottom of the score of 40 μm).

The punch thus made an angle alpha of 60°, its bisecting line being oriented vertically (angle gamma=0).

First Series of Tests

The tests consisted in varying the residual thickness R on the one hand (residual of 50 μm/60 μm/70 μm/95 μm), and in varying the inclination beta of the score strip (6) of the cover outline to be scored.

The results of two comparative tests, among the various tests carried out, are described in detail hereinafter, with:

an angle beta of 0° according to the prior art, an angle beta of 15° according to the invention.

For each pair of values of R and angle beta of the score strip (6), 200 easy-to-open lids were manufactured.

The lids obtained were crimped on cans which were then sterilised in the conventional way (30 minutes at 125° C.). Metallographic sections were taken of the manufactured lids per se, of the lids after crimping, and of the lids after sterilisation, in order to carry out reflection optical microscopy examinations and evaluate the presence and size of cracks at the bottom of and underneath the score.

Evaluation of the cracks according to their frequency and length:

a) presence of cracks
Yes=more than 1 out of 10 lids
Infrequent=1 out of 10 to 1 out of 100
No=less than 1 out of 100.

b) length of the cracks:
<2 μm –5 μm (crack starting points)
cracks larger than 5 μm.

The distinction between a crack starting point and the crack itself is based on the fact that the risk of damage does not appear to be in a linear relationship to the length of the cracks, and that there is a threshold (2–5 μm) above which there is a large probability that cracks will propagate instead of remaining relatively stable as in the case of crack starting points.

Results Obtained on Manufactured Lids Per Se

| PARAMETERS | Angle beta | 0° (prior art) | 15° (invention) |
|---|---|---|---|
| Residual R | 50 μm | a) total rupture | some cracks |
| | | b) | <10 μm |
| | 60 μm | a) Yes | infrequent |
| | | b) >10 μm | <2 μm |
| | 70 μm | a) Yes | No |
| | | b) 2 to 5 μm | — |
| | 95 μm | a) No | No |
| | | b) — | — |

The results obtained after crimping and after sterilisation show the same picture, with a trend towards an increase in the number and/or depth of the cracks. Furthermore, the manual opening tests gave results (ease of opening) that were comparable for the same value of residual R.

These results clearly show the effect of the angle beta on the appearance of cracks at the bottom of the score.

Second Series of Tests

Lids similar to those of the first series of tests were manufactured, except that in this case the asymmetrical flow is not obtained as the result of a score strip of angle beta different from 0, but by using an asymmetrical punch of the "50P25" type, as shown in FIG. 8 by the corresponding score, with:

alpha : 50° beta : 0° gamma : 10° delta : 35° rho : 15°

Results Obtained on Manufactured Lids Per Se

| PARAMETERS | Angle gamma | 0° (prior art) | 0° (invention) |
|---|---|---|---|
| Residual R | 50 μm | a) total rupture | infrequent |
| | | b) | <5 μm |
| | 60 μm | a) Yes | infrequent |
| | | b) >10 μm | <2 μm |
| | 70 μm | a) Yes | No |
| | | b) 2 to 5 μm | — |
| | 95 μm | a) No | No |
| | | b) — | — |

The control lids are the same as those of the first series of tests.

Third Series of Tests

In this series of tests lids similar to those of the second series of tests were manufactured, except that the asymmetrical flow is not obtained by virtue of a score strip of angle gamma different to 0, but by the use of a non-standard anvil, such as shown in FIG. 10 and defined by an angle phi of 10°.

Results Obtained On Manufactured Lids Per Se

| PARAMETERS | Anvil | (prior art) | (invention) |
|---|---|---|---|
| Residual R | 50 μm | a) total rupture | infrequent |
| | | b) | <10 μm |
| | 60 μm | a) Yes | infrequent |
| | | b) >10 μm | 2 μm |
| | 70 μm | a) Yes | No |
| | | b) 2 to 5 μm | — |
| | 95 μm | a) No | No |
| | | b) — | — |

The control lids are the same as those used in the first series of tests.

All the results of these various series of tests are of great practical importance. The results show that the lids obtained according to the invention have, at the end of sterilisation, scores that are undamaged or only slightly damaged by cracks or crack starting points, whether at the bottom of the score or underneath the score. These lids thus have a behaviour to mechanical stresses, typically a behaviour to shock, that is significantly better than that of lids of the prior art. This which is reflected, in the case of canned foods normally stored on high-stacked pallets, in a marked decrease in the risk of damage, for it only needs one perforated can to contaminate all or part of a pallet stored under plastic film for any length of time.

Furthermore, according to the corrosion behaviour studies carried out by the applicant, the residual metal layer underneath the score is particularly sensitive to the action of corrosion due to ingredients of the packaged products (possible presence of acids and/or salts), and the corrosion sensitivity increases with the number of cracks and the length of the cracks.

From a qualitative approach there is thus a correlation between damage to the score, which may be quantified by the presence of cracks and their length, and the corrosion behaviour.

The positive consequences of the marked decrease in crack formation at the bottom of the score or underneath the score in the lids according to the invention are of several types:

on the one hand, for the lid manufacturer it is important to have a safety range as regards the value of the residual thickness of metal. In the present case, practically all the tested values for R, ranging from 50 to 95 μm, are satisfactory. In fact, production becomes more costly in terms of tools, quality control and rejects the more it has to satisfy a strict range of values for a given parameter such as the residual thickness of metal. Moreover, the improvement in the corrosion behaviour may also allow the thickness of the internal surface coating to be reduced.

on the other hand, the improvement in the corrosion behaviour is reflected in an increase in the shelf life of the packaged products and in the corresponding reduction in the risk of perforation of the cans, with all the attendant risks of contamination and spoilage.

finally, the possibility of being able to reduce the value of the residual thickness of metal within a large range of values enables the effort required to open easy-to-open lids to be varied and reduced as desired. In contrast, the lids of the prior art require, for the same corrosion behaviour, a significantly larger residual thickness value, and thus involve a greater opening effort. These are accordingly the major advantages in the field of packaging obtained by using easy-to-open lids according to the invention.

What is claimed is:

1. A process for forming an easy to open lid comprising a central panel having a portion which is a score strip with a score in a surface of the score strip, a crimping edge and a ring enabling the lid to be opened by perforating the panel at the score, the process comprising forming the score in a score strip of a metal lid outline supported by an anvil by displacing thereover a punch having sides with an angle alpha therebetween to produce a score having walls having angle alpha therebetween, and causing an asymmetrical flow of metal between the punch and the anvil during the displacing, thereby reducing the risk of cracks formation in the metal at a bottom portion of the score or beneath the score, the anvil having a thickness e of at least 10 μm and a length L approximately equal to a theoretical length L' defined as a length along an opposite surface of the score strip between intersections of the opposite surface with extensions of the walls of the score.

2. A process according to claim 1, wherein the punch has an asymmetrical geometric configuration, a line bisecting angle alpha of the walls making a non-zero angle gamma with a direction of the displacing.

3. A process according to claim 1, wherein the score strip of the lid outline has an angle beta different from 0° with respect to a horizontal plane, or different from 90° with respect to a direction of displacement, the anvil being constructed and arranged to have an angle of inclination which optionally differs from angle beta.

4. A process according to claim 1, wherein the punch has an asymmetrical roughness, one side of angle alpha of the punch being rougher than an opposite side.

5. A process according to claim 1, wherein the anvil comprises a lower relief eccentric by no more than 500 μm with respect to the punch, or that is asymmetric.

6. A process according to claim 2, wherein the direction of displacing divides the angle alpha into two angles delta and rho having a sum equal to angle alpha, wherein the punch has an angle alpha between 30° and 70°, and wherein the angles delta and rho differ by an amount having an absolute value of at least 3°.

7. A process according to claim 1, wherein the punch is a radiused punch having sides either connected to one another, or to a flat extremity of the punch.

8. A process according to claim 7, wherein the punch has a flat extremity between 0 and 25 $\mu$m long, so as to produce a score of width P less than 40 $\mu$m.

9. A process according to claim 6, wherein the angle alpha is between 40° and 60°.

10. A process according to claim 8, wherein the width P is between 10 and 30 $\mu$m.

11. A process according to claim 1, wherein the thickness e is less than a thickness E of the score strip.

12. An easy to open metal lid produced by the process of claim 1, wherein:

the lid comprises a material selected from the group consisting of steel, iron-based alloys, aluminum and aluminum-based alloys;

the angle alpha of the score is between 30° and 70°;

the lid has a nominal thickness between 0.12 and 0.30 mm; and the lid has a residual thickness beneath the score which is greater than 40 $\mu$m.

13. A lid according to claim 12, wherein the angle alpha is between 40° and 60°, and the score has a width P at its bottom of between 10 and 40 $\mu$m.

14. A lid according to claim 12, wherein the score strip makes a non-zero angle beta with respect to a mid-plane of the central panel.

15. A lid according to claim 14, wherein the score strip forms an inclined plane between the central panel and an internal skirt portion of the crimping edge.

16. A lid according to claim 14, comprising a peripheral counter-dish, the score strip being disposed between the central panel and the counter-dish and forming an inclined plane.

17. A lid according to claim 14 which can be partially opened, wherein the score strip forms an inclined plane abutting a part of the central panel intended to be opened.

18. A lid according to claim 14, wherein the angle beta is between 5° and 45°.

19. A lid according to claim 18, wherein the angle beta is less than 30°.

* * * * *